US006218957B1

(12) United States Patent
Tada

(10) Patent No.: US 6,218,957 B1
(45) **Date of Patent: *Apr. 17, 2001**

(54) RADIO SELECTIVE CALLING RECEIVER

(75) Inventor: Ken-ichi Tada, Shizuoka (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/911,934

(22) Filed: Aug. 15, 1997

(30) Foreign Application Priority Data

Aug. 15, 1996 (JP) ..... 8-215698

(51) Int. Cl.[7] ..... G08B 5/22
(52) U.S. Cl. ..... 340/825.44; 345/124
(58) Field of Search ..... 345/123, 124, 345/127, 128, 129, 130, 950; 340/825.44

(56) References Cited

U.S. PATENT DOCUMENTS 4,646,081 * 2/1987 Tsunoda ..... 340/825.44
5,838,295 * 11/1998 Aoyama ..... 345/124

FOREIGN PATENT DOCUMENTS

| | | |
|---|---|---|
| 32 28 589 | 2/1984 | (DE) . |
| 61-59922 | 3/1986 | (JP) . |
| 01265733 | 10/1989 | (JP) . |
| 4-225629 | 8/1992 | (JP) . |
| 7-240953 | 9/1995 | (JP) . |

* cited by examiner

*Primary Examiner*—Michael Horabik
*Assistant Examiner*—Matsuichiro Shimizu
(74) *Attorney, Agent, or Firm*—Scully, Scott Murphy & Presser

(57) ABSTRACT

A radio selective calling receiver which allows anybody to read characters easily which disappear when a message is scrolled up on a screen by means of a simple display. A control circuit 2 is used to scroll the message displayed on the screen vertically in units of a dot and to switch characters on a line which gradually disappear due to the scrolling to a simple display which can be recognized as characters at the point when they cannot be recognized as characters, based on a switch operation of a switching circuit 5.

2 Claims, 6 Drawing Sheets

RADIO SELECTIVE CALLING RECEIVER

BACKGROUND OF THE INVENTION

1. Field of the Invention

The present invention relates to a radio selective calling receiver having a display function.

2. Description of the Prior Art

Conventionally, there is a known radio selective calling receiver having a message display function. This type of a radio selective calling receiver has generally a display unit which is not large enough to display an entire long message at a time and therefore which scrolls such a long message in units of a column or a line to display the entire message. As an example, there is disclosed a radio selective calling receiver in which a message is scrolled in units of a dot on a screen, for example, in Japanese Non-examined Patent Publication No. HEI 1-265733. In this radio selective calling receiver, if an attempt is made to display a message having 21 characters of 123ｱｲｳｴ456ABCD789ｶｷｸｹ on a display unit on which 14 characters can be displayed on two lines, initially 14 characters of 123 ｱｲｳｴ456ABCD are displayed from the beginning of the message as shown in FIG. 1A. When the currently-displayed seven characters are scrolled up in units of a dot to display seven characters of 789 ｶｷｸｹ which are not displayed yet, the upper dots of 123 ｱｲｳｴ on the first line gradually disappear as shown in FIG. 1B and the upper dots of 789ｶｷｸｹ on the third line begin to appear at the same time.

In the conventional radio selective calling receiver, however, there is a problem that, when a part of the characters on the uppermost line disappears due to the scrolling as described in the above, it becomes very hard to recognize the characters, which makes it impossible to check the connection with a part of the message on the lower line.

SUMMARY OF THE INVENTION

The present invention is provided to solve the above problem. It is therefore an object of the present invention to provide a radio selective calling receiver which allows a message to be easily read by anybody with a definitive display showing a connection in a message being scrolled on a screen.

To achieve the object described above, a radio selective calling receiver according to the invention has a control circuit for scrolling a message displayed on a screen vertically in units of a dot and then switching characters on the line gradually disappearing due to the scrolling to a simple display which can be recognized as characters when it becomes impossible to recognize them as characters based on a switch operation of a switching circuit.

Furthermore, a radio selective calling receiver according to the invention has the control circuit for scrolling a message displayed on the screen vertically in units of a dot and then, if the message is scrolled up, erasing the characters on the uppermost line gradually from the lower dots without scrolling the characters on the uppermost line or, if the message is scrolled down, displaying the characters from the upper dots of the characters on the uppermost line which appear due to the scrolling, based on a switch operation of the switching circuit.

Still furthermore, a radio selective calling receiver according to the invention has the control circuit for scrolling a message displayed on the screen vertically in units of a dot and then, if the message is scrolled down, switching the simple display which can be recognized as characters to the normal display according to the number of the displayed dots on the characters on the uppermost line which appear due to the scrolling, based on a switch operation of the switching circuit.

DETAILED DESCRIPTION OF THE PREFERRED EMBODIMENTS

The present invention will now be described below by reference to accompanying drawings.

Figure 1A:
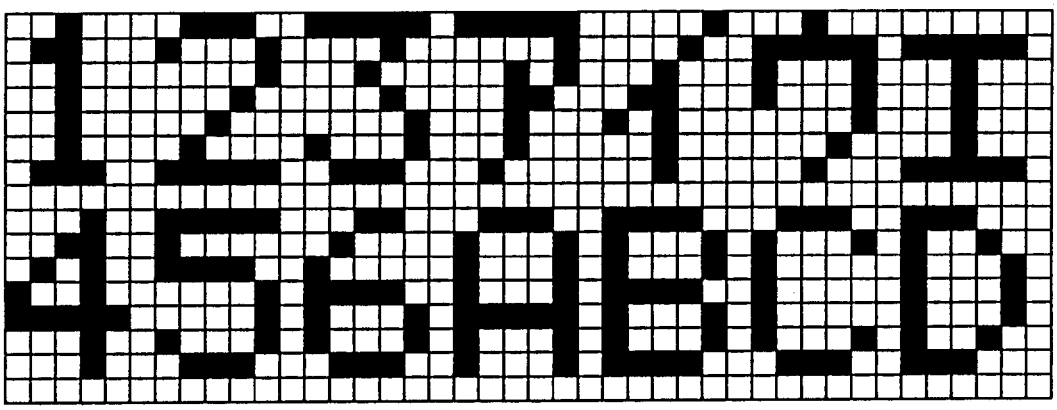
FIG. 1A (PRIOR ART)
FIGS. 1A and 1B are screen display diagrams illustrating a change caused by a scroll operation for a message displayed in a conventional radio selective calling receiver.
Figure 1B:
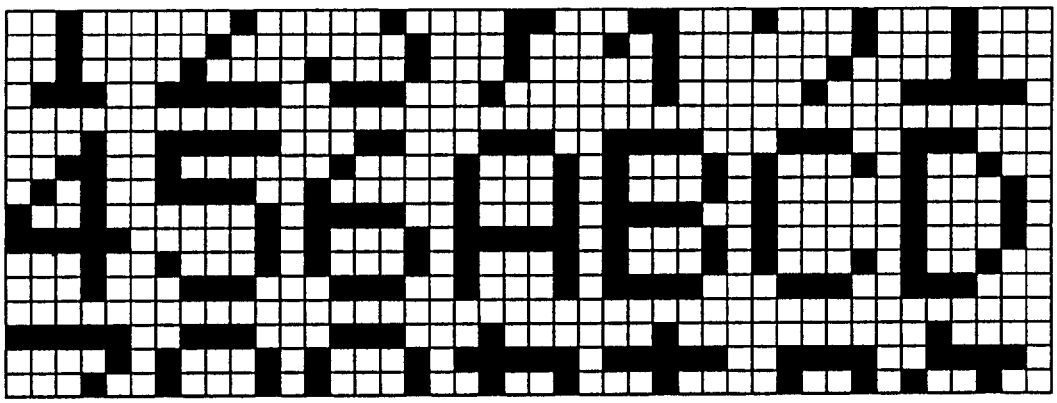
FIG. 1B (PRIOR ART)
Figure 2:
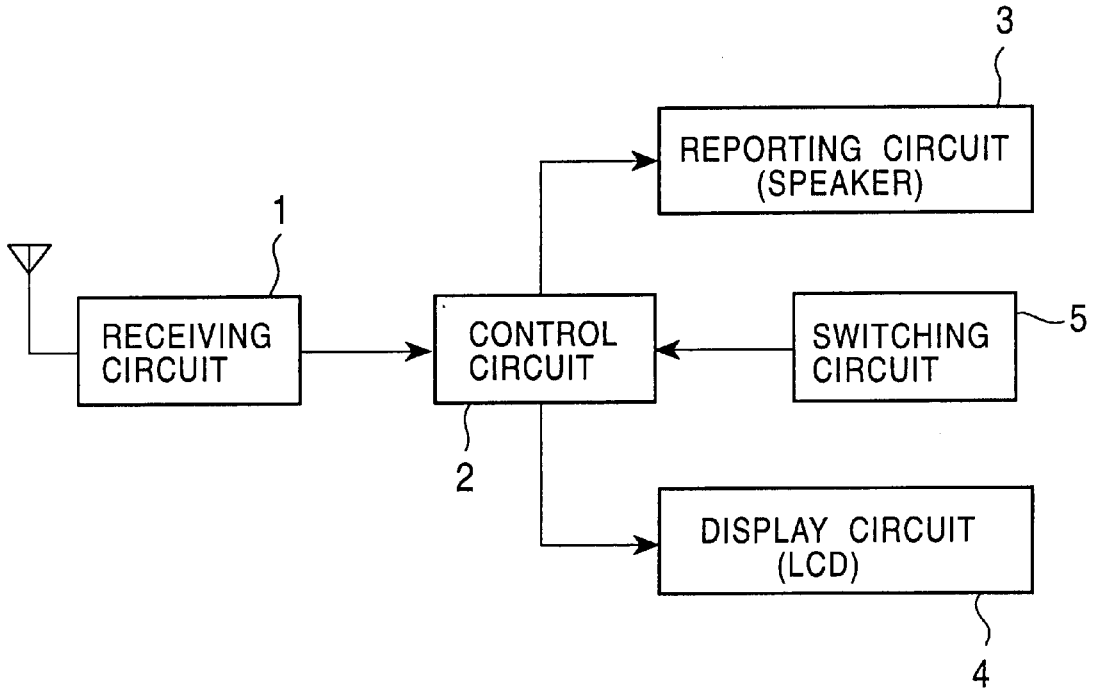
FIG. 2 is a block diagram of an embodiment of a radio selective calling receiver according to the present invention.

Referring to FIG. 2, a block diagram shows a radio selective calling receiver of the present invention. In this drawing, a receiving circuit 1 receives a radio selective call signal and a control circuit 2 detects a call to itself based on the received radio selective call signal and then causes a call reporting circuit 3 to report the call and a display circuit 4 to display a message. A switching circuit 5 is used for a switch operation to scroll a message on a screen of the display circuit 4 under a control of the control circuit 2.

Next, operations will be described below. First, when the receiving circuit 1 receives a radio selective call signal, the control circuit 2 determines whether or not the radio selective call signal is directed to itself. If the call signal is directed to itself, the control circuit 2 causes the reporting circuit 3 to report that a call is received. At the same time, the switching circuit 5 causes the display circuit 4 to display a received message under a control of the control circuit 2 by operating it. If it is required to check the connection of the contents on the display screen, the message is scrolled on the screen with the switch operation of the switching circuit 5.

Figure 3A:
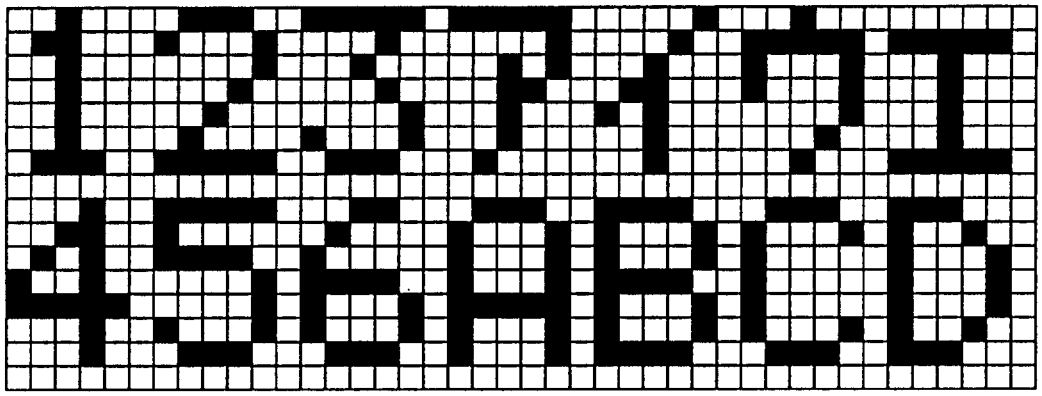
FIGS. 3A and 3B are screen display diagrams illustrating a change caused by a scroll operation for a message displayed in the radio selective calling receiver of the present invention.
Figure 3B:
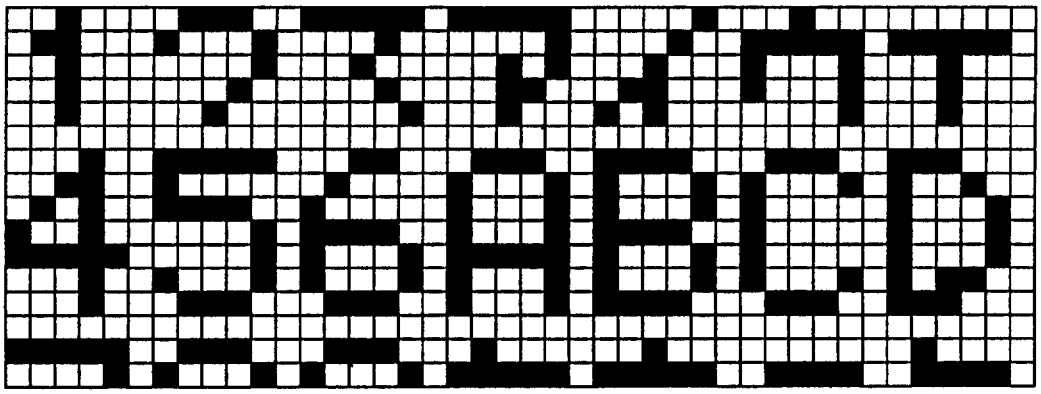

Referring to FIGS. 3A and 3B, there are shown screen display diagrams for an explanation of the scroll operation described in the above, with a sample display of a message which is not scrolled yet in FIG. 3A. In this embodiment, although a display space for a single character is composed of dots in a 6 by 8 matrix, the dots in the rightmost column and the lowermost row in each display space are left to be blank so as to clarify a boundary between characters adjacent each other and therefore actually a character is displayed in a 5 by 7 dot matrix. FIG. 3B shows a sample display in which the message is scrolled up by two dots. In other words, in this scrolling method, with the characters 123ｱｲｳｴ in the first row being fixed, the characters above the blank portion between the first- and second-line characters are scrolled up. In this case, lower two dots of the first-line characters 123ｱｲｳｴ disappear and upper two dots of the third-line characters (789ｶｷｸｹ) newly appear on the screen.

Figure 4A:
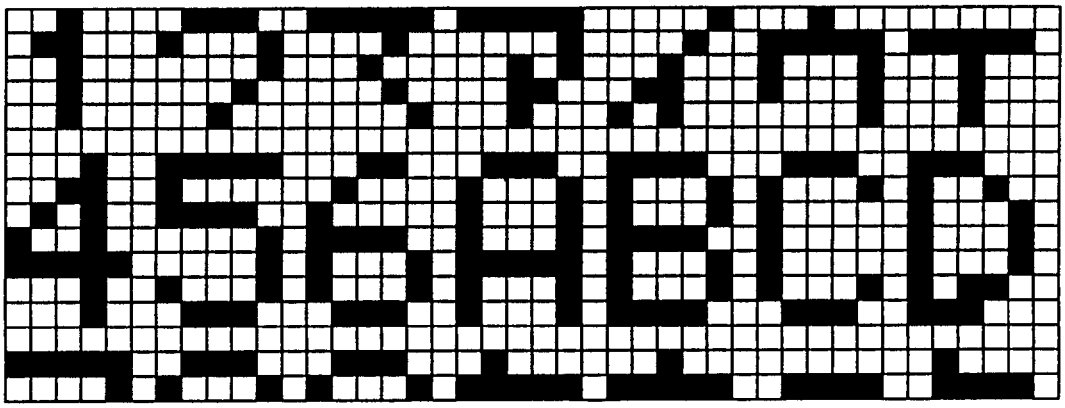
FIGS. 4A and 4B are screen display diagrams illustrating a change caused by another scroll operation for a message displayed in the radio selective calling receiver of the present invention.
Figure 4B:
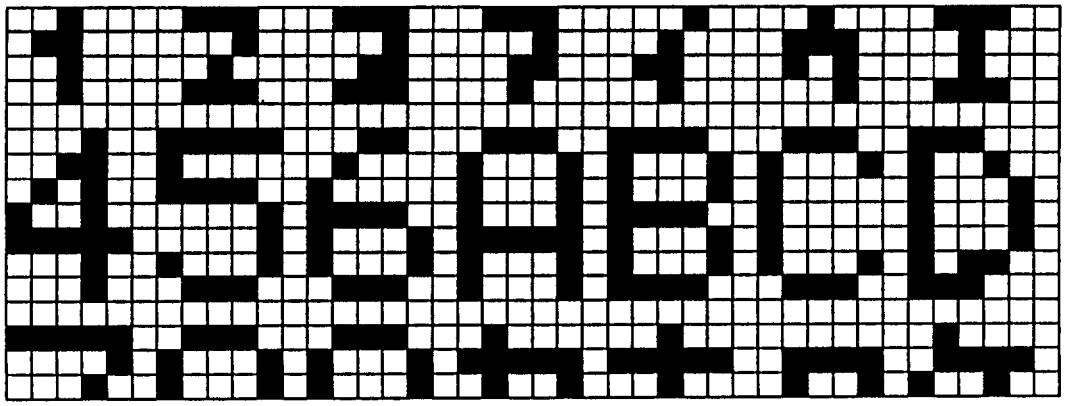

Referring to FIGS. 4A and 4B, screen display diagrams show another scroll operation in the present invention. In this embodiment, the characters are scrolled up further by one dot from a display state shown in FIG. 4A and, when the first-line characters are displayed in a 5 by 4 dot matrix in which it becomes impossible to recognize as characters the first-line characters (123ｱｲｳｴ) gradually disappearing, the first-line characters (123ｱｲｳｴ) are switched to a simple display as shown in FIG. 4B. If the scrolling is advanced further, the display is switched so that the characters disappear from the lower dots of the first-line simple display.

Figure 5A:
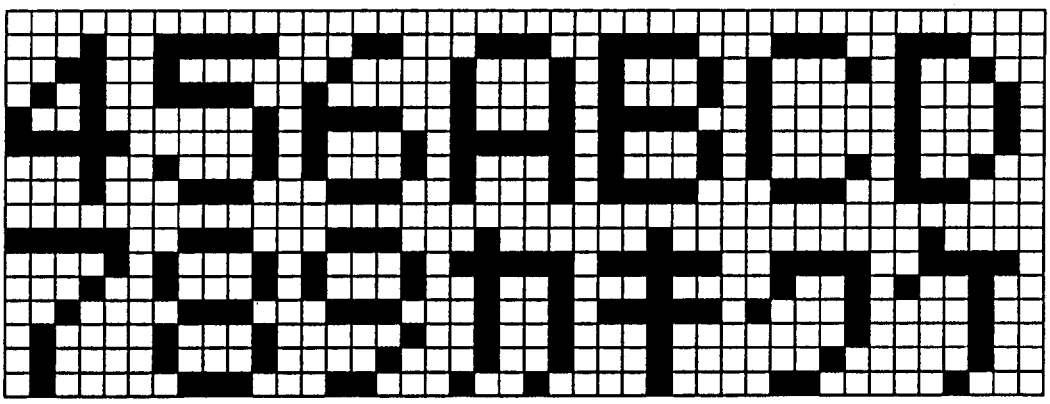
FIGS. 5A and 5B are screen display diagrams illustrating a change caused by still another scroll operation for a message displayed in the radio selective calling receiver of the present invention.
Figure 5B:
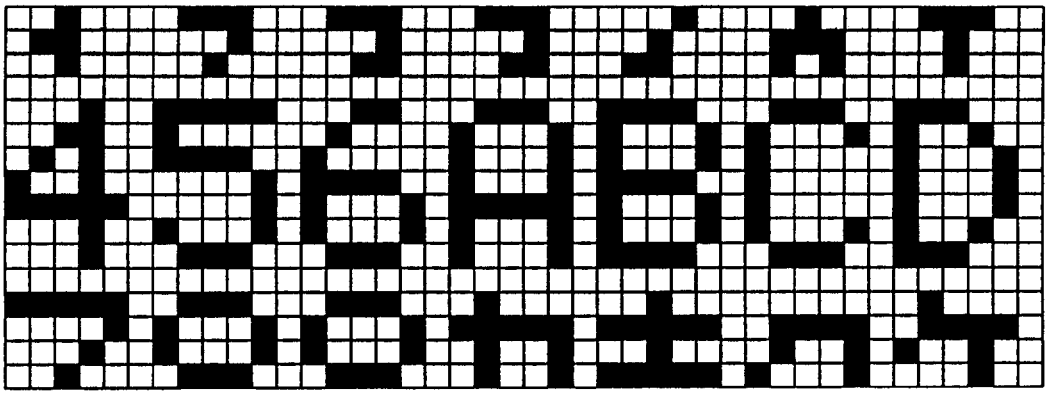
Figure 6:
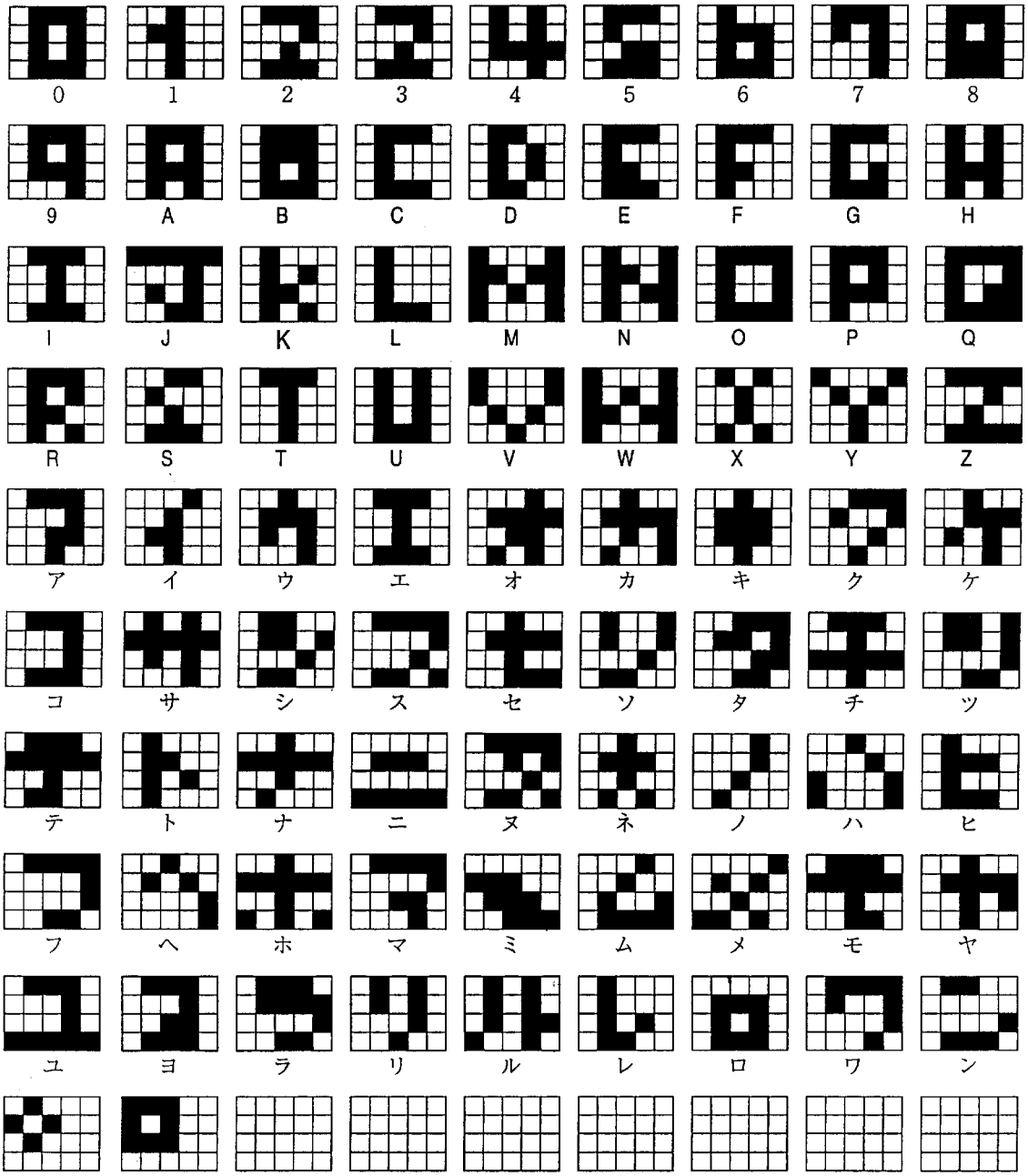
FIG. 6 is a display diagram illustrating a sample font for a simple display used in the scroll operations of the present invention.

FIGS. 5A and 5B show screen display diagrams illustrating still another scroll operation in the present invention. In this embodiment, an explanation will be made for a scroll-down operation of a message. The entire characters shown in FIG. 5A are scrolled down, and new characters (123ｱｲｳｴ) which appear as a result are initially represented by a simple display and then switched to a normal display when a part of characters appears by a 5 by 5 dot matrix due to the scrolling. The second-line characters (789ｶｷｸｹ) which disappear due to the scroll-down operation sequentially disappear from the lower dots as shown in FIG. 5B. Referring to FIG. 6, there is shown an example of an LCD font for a simple display used in the scrolling in FIGS. 4A and 4B and FIGS. 5A and 5B.

As set forth hereinabove, according to the present invention, a radio selective calling receiver is configured to have a control circuit for scrolling a message displayed on a screen vertically in units of a dot and then switching characters on the line gradually disappearing due to the scrolling to a simple display which can be recognized as characters when it becomes impossible to recognize them as characters based on a switch operation of a switching circuit, and therefore advantageously the message can be easily read in association with the characters on the line which still remains.

Furthermore, according to the invention, a radio selective calling receiver is configured to have the control circuit for scrolling a message displayed on the screen vertically in units of a dot and then, if the message is scrolled up, erasing the characters on the uppermost line gradually from the lower dots without scrolling the characters on the uppermost line or, if the message is scrolled down, displaying the characters from the upper dots of the characters on the uppermost line which appear due to the scrolling, based on a switch operation of the switching circuit, and therefore advantageously a connection between characters, in other words,. a connection in the message can be easily checked almost completely even if the message is being scrolled, by means of a scroll operation in which the characters in the uppermost line are erased from the lower dots while leaving the upper dots distinctive in the characters.

Still further, according to the invention, a radio selective calling receiver is configured to have the control circuit for scrolling a message displayed on the screen vertically in units of a dot and then, if the message is scrolled down, switching the simple display which can be recognized as characters to the normal display according to the number of the displayed dots on the characters on the uppermost line which appear due to the scrolling, based on a switch operation of the switching circuit, and therefore advantageously the characters on the uppermost line can be easily read at scrolling down.

What is claimed is:

1. A radio selective calling receiver comprising:

a receiving circuit for receiving a radio selective call signal;

a control circuit for detecting a call to itself based on said received radio selective call signal and then causing a reporting circuit to report the call and a display circuit to display a message containing characters; and a switching circuit used for a switch operation to scroll said message on a screen of the display circuit, wherein said control circuit scrolls said message displayed on the screen vertically in units of a dot and then switches the characters of the message on the line gradually disappearing due to the scrolling to a simple display comprising characters which are whole alternative characters that can be recognized as the characters of the message when it becomes impossible to recognize the characters based on a switch operation of said switching circuit.

2. A radio selective calling receiver comprising:

a receiving circuit for receiving a radio selective call signal;

a control circuit for detecting a call to itself based on said received radio selective call signal and then causing a reporting circuit to report the call and a display circuit to display a message containing characters; and a switching circuit used for a switch operation to scroll said message on a screen of the display circuit, wherein said control circuit scrolls said message displayed on said screen vertically in units of a dot and, if the message is scrolled down, initially shows a simple display comprising characters which are whole alternative characters that can be recognized as the characters of the message on the uppermost line which appear due to the scrolling and then switches said simple display to a normal display according to the number of the displayed dots, based on a switch operation of said switching circuit.

* * * * *